US008360788B2

(12) United States Patent
Wu et al.

(10) Patent No.: US 8,360,788 B2
(45) Date of Patent: Jan. 29, 2013

(54) FREELY ROTATABLE ELECTRICAL CONDUCTION STRUCTURE AND RECEPTACLE USING THE SAME

(75) Inventors: Jui-Hsiung Wu, Taipei (TW); Yan-Lin Wang, Guangdong (CN)

(73) Assignees: Well Shin Technology Co., Ltd., Taipei (TW); Dongguan Well Shin Electronic Products Co., Ltd., Guangdong (CN)

( * ) Notice: Subject to any disclaimer, the term of this patent is extended or adjusted under 35 U.S.C. 154(b) by 94 days.

(21) Appl. No.: 13/089,570

(22) Filed: Apr. 19, 2011

(65) Prior Publication Data

US 2012/0270414 A1 Oct. 25, 2012

(51) Int. Cl.
*H01R 39/00* (2006.01)

(52) U.S. Cl. ..... 439/26; 439/22

(58) Field of Classification Search ..... 439/11, 439/13, 15, 18–28

See application file for complete search history.

(56) References Cited

U.S. PATENT DOCUMENTS 5,234,347 A * 8/1993 Kang ..... 439/26
5,425,645 A * 6/1995 Skovdal et al. ..... 439/23
5,595,503 A * 1/1997 Pittman et al. ..... 439/446
5,846,090 A * 12/1998 Lu ..... 439/26
6,068,490 A * 5/2000 Salzberg ..... 439/25
7,125,256 B2 * 10/2006 Gerard ..... 439/21
7,364,108 B2 * 4/2008 Kim et al. ..... 242/370
7,740,484 B1 * 6/2010 Chiang ..... 439/13

* cited by examiner

*Primary Examiner* — Thanh Tam Le
(74) *Attorney, Agent, or Firm* — WPAT, P.C.; Anthony King

(57) ABSTRACT

The present invention provides a freely rotatable electrical conduction structure including at least two cylindrical electrical conduction portions, an insulated material portion and at least two electrical conduction terminals. The at least two cylindrical electrical conduction portions are arranged separately along an axis, wherein the inner surface of each cylindrical electrical conduction portion is welded with an end of a conducting wire. The insulated material portion is combined with the at least two cylindrical electrical conduction portions via injection molding to form a circular shaft assembly. The at least two electrical conduction terminals correspond to the at least two cylindrical electrical conduction portions respectively, and each electrical conduction terminal partially projects to form an arc contact portion configured to abut onto the outer peripheral surface of its corresponding cylindrical electrical conduction portion. Each electrical conduction terminal is allowed to rotate around its corresponding cylindrical electrical conduction portion with its arc contact portion keeping contacting and conducting with the outer peripheral surface.

7 Claims, 8 Drawing Sheets

FREELY ROTATABLE ELECTRICAL CONDUCTION STRUCTURE AND RECEPTACLE USING THE SAME

BACKGROUND OF THE INVENTION

1. Field of the invention

The invention relates to an electrical conduction structure, and more particularly, to a freely rotatable electrical conduction structure applicable to a receptacle.

2. The Related Art

Traditionally, receptacles of a wall outlet or an extension cord are usually fixed, arranged in line, and can be used for multiple power plugs at the same time. However, sometimes it may be inconvenient for users that all receptacles can not be used at the same time because the interval between receptacles is too short or certain power plug has large volume or a particular shape to block the plugging of one or more plugs. Consequently, it is required for receptacles of a wall outlet or an extension cord to provide flexible use to avoid the above situations.

SUMMARY OF THE INVENTION

The main object of the invention is to provide a freely rotatable electrical conduction structure including at least two cylindrical electrical conduction portions, an insulated material portion and at least two electrical conduction terminals.

The at least two cylindrical electrical conduction portions are arranged separately along an axis, wherein the inner surface of each cylindrical electrical conduction portion is welded with an end of a conducting wire. The insulated material portion is combined with the at least two cylindrical electrical conduction portions via injection molding to form a circular shaft assembly. The at least two electrical conduction terminals correspond to the at least two cylindrical electrical conduction portions, respectively, and each electrical conduction terminal partially projects to form an arc contact portion configured to abut onto the outer peripheral surface of its corresponding cylindrical electrical conduction portion. Each electrical conduction terminal is allowed to rotate around its corresponding cylindrical electrical conduction portion with its arc contact portion keeping contacting and conducting with the outer peripheral surface.

A freely rotatable receptacle is provided in one embodiment of the present invention. The receptacle includes a circular plate, a first cylindrical electrical conduction portion, a second cylindrical electrical conduction portion, a third cylindrical electrical conduction portion, a live-wire electrical conduction terminal, a neutral-wire electrical conduction terminal, an earth-wire electrical conduction terminal, and an insulated material portion.

The circular plate is formed with a set of 3-pole insertion holes. The first cylindrical electrical conduction portion, the second cylindrical electrical conduction portion, and the third cylindrical electrical conduction portion are arranged separately along an axis, wherein the inner surface of the first cylindrical electrical conduction portion is welded with an end of a live wire, the inner surface of the second cylindrical electrical conduction portion is welded with an end of a neutral wire, the inner surface of the third cylindrical electrical conduction portion is welded with an end of an earth wire. The insulated material portion is combined with the first cylindrical electrical conduction portion, the second cylindrical electrical conduction portion, and the third cylindrical electrical conduction portion via injection molding to form a circular shaft assembly disposed under the circular plate.

The live-wire electrical conduction terminal, the neutral-wire electrical conduction terminal and the earth-wire electrical conduction terminal partially project to form a first arc contact portion configured to abut onto the outer peripheral surface of the first cylindrical electrical conduction portion, a second arc contact portion configured to abut onto the outer peripheral surface of the second cylindrical electrical conduction portion, and a third arc contact portion configured to abut onto the outer peripheral surface of the third cylindrical electrical conduction portion, respectively.

The live-wire electrical conduction terminal, the neutral-wire electrical conduction terminal and the earth-wire electrical conduction terminal are allowed to rotate around the first cylindrical electrical conduction portion, the second cylindrical electrical conduction portion, and the third cylindrical electrical conduction portion, respectively, with the first arc contact portion, the second arc contact portion and the third arc contact portion keeping contacting and conducting with the outer peripheral surface of the first cylindrical electrical conduction portion, the outer peripheral surface of the second cylindrical electrical conduction portion, and the outer peripheral surface of the third cylindrical electrical conduction portion, respectively.

The advantage and spirit of the invention may be understood by the following recitations together with the appended drawings.

DETAILED DESCRIPTION OF THE PREFERRED EMBODIMENT

Figure 4:
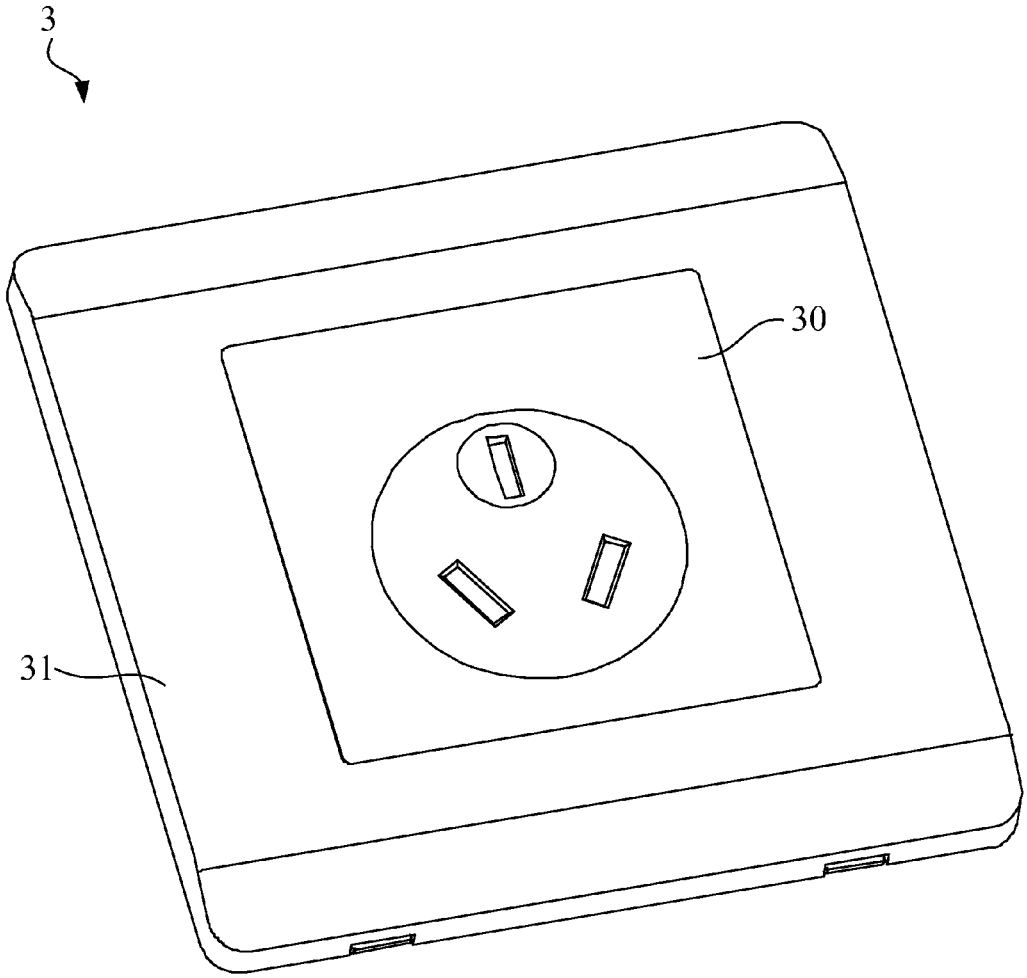
FIG. 4 is an exterior view of a freely rotatable receptacle according to one embodiment of the present invention.

The main object of the invention is to provide a freely rotatable electrical conduction structure. Please refer to FIG. 4 which illustrates a freely rotatable receptacle 3 utilizing the above-mentioned electrical conduction structure according to one embodiment of the present invention. It should be noted that the quantity of the receptacle is not limited to one as shown in FIG. 4.

Figure 5:
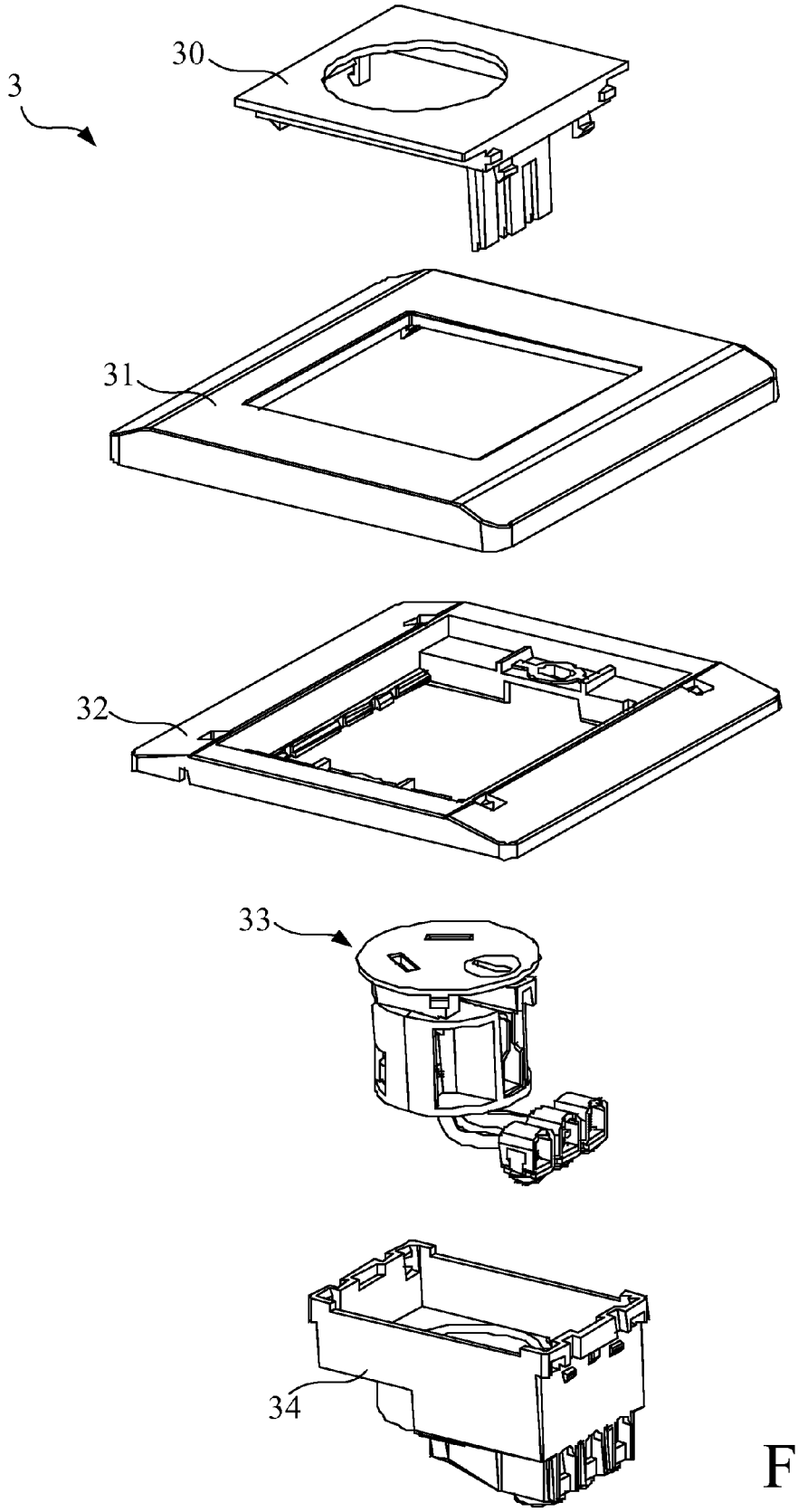
FIG. 5 is an explosive view of the receptacle in FIG. 4.
Figure 6:
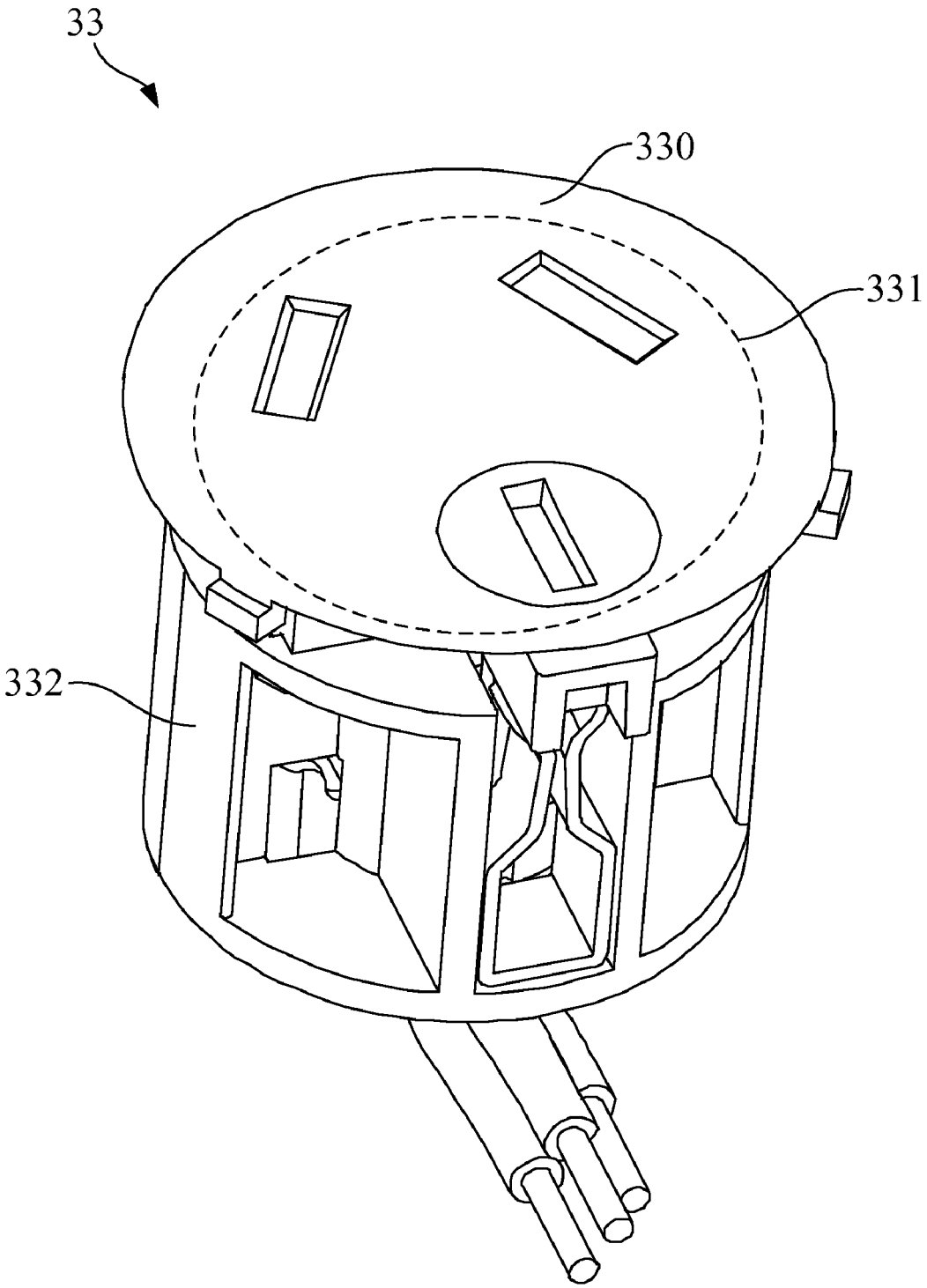
FIG. 6 is an exterior view of the main body of the receptacle.
Figure 7:
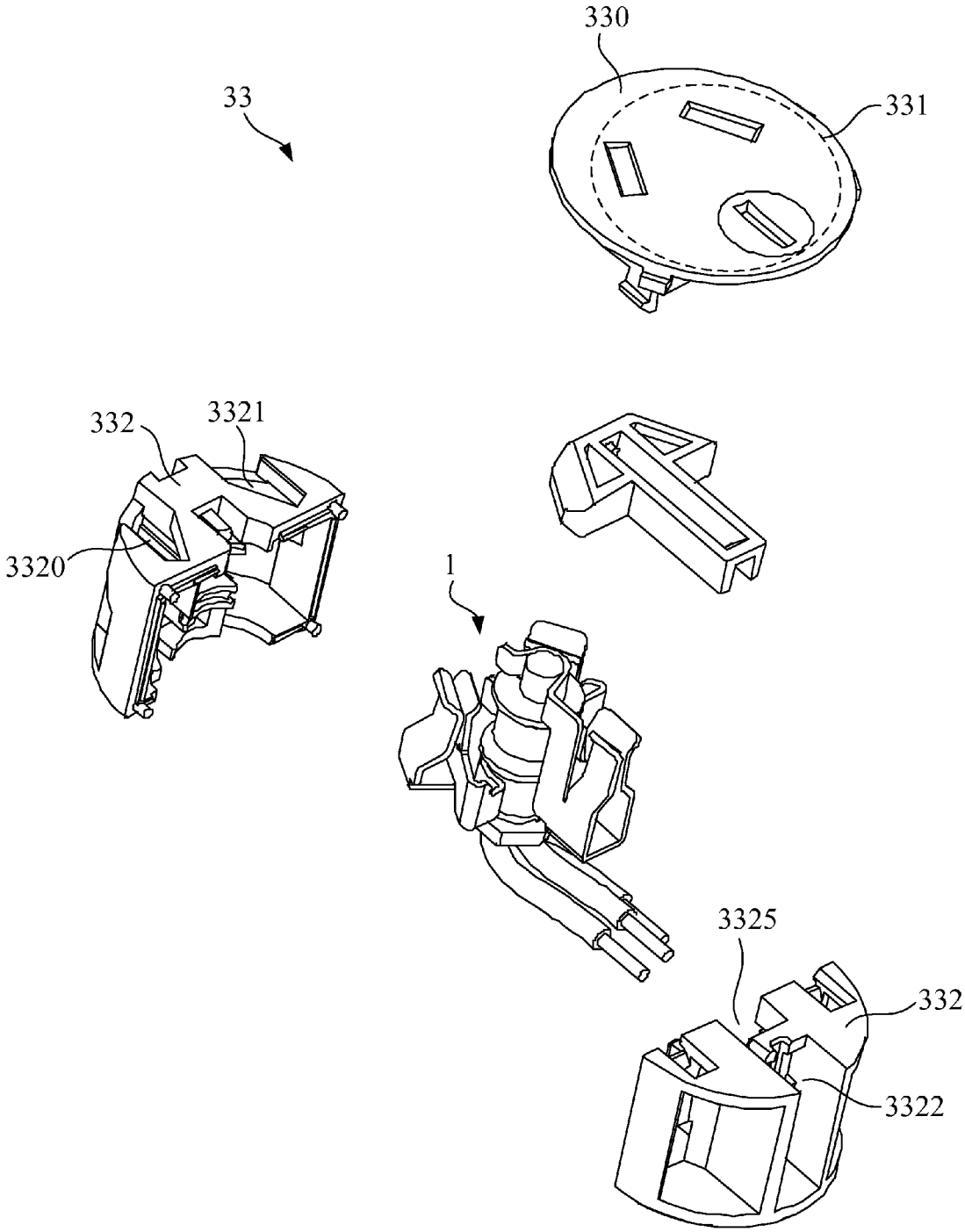
FIG. 7 is an explosive view of the main body of the receptacle.

As shown in FIG. 5, the receptacle 3 can include casings (30, 31, and 32), a main body 33, and a box 34 for receiving the main body 33. Please refer to FIGS. 6 and 7. The main body 33 can include a circular plate 330, an electrical conduction structure 1 and a rotatable supporting seat 332. In this embodiment, the circular plate 330 may be formed with a set of 3-pole insertion holes 331 adapted for, but not limited to, a power plug of China or Australian electric standard. The electrical conduction structure 1 is disposed under the circular plate 330. The rotatable supporting seat 332 may be divided into a left part and a right part, and the electrical conduction structure 1 can be received inside the two parts after combination. The rotatable supporting seat 332 includes a first receiving space 3320, a second receiving space 3321 and a third receiving space 3322 formed from the outer top thereof and corresponding to the set of 3-pole insertion holes 331. Beside, the rotatable supporting seat 332 includes a central vertical channel 3325.

Figure 1:
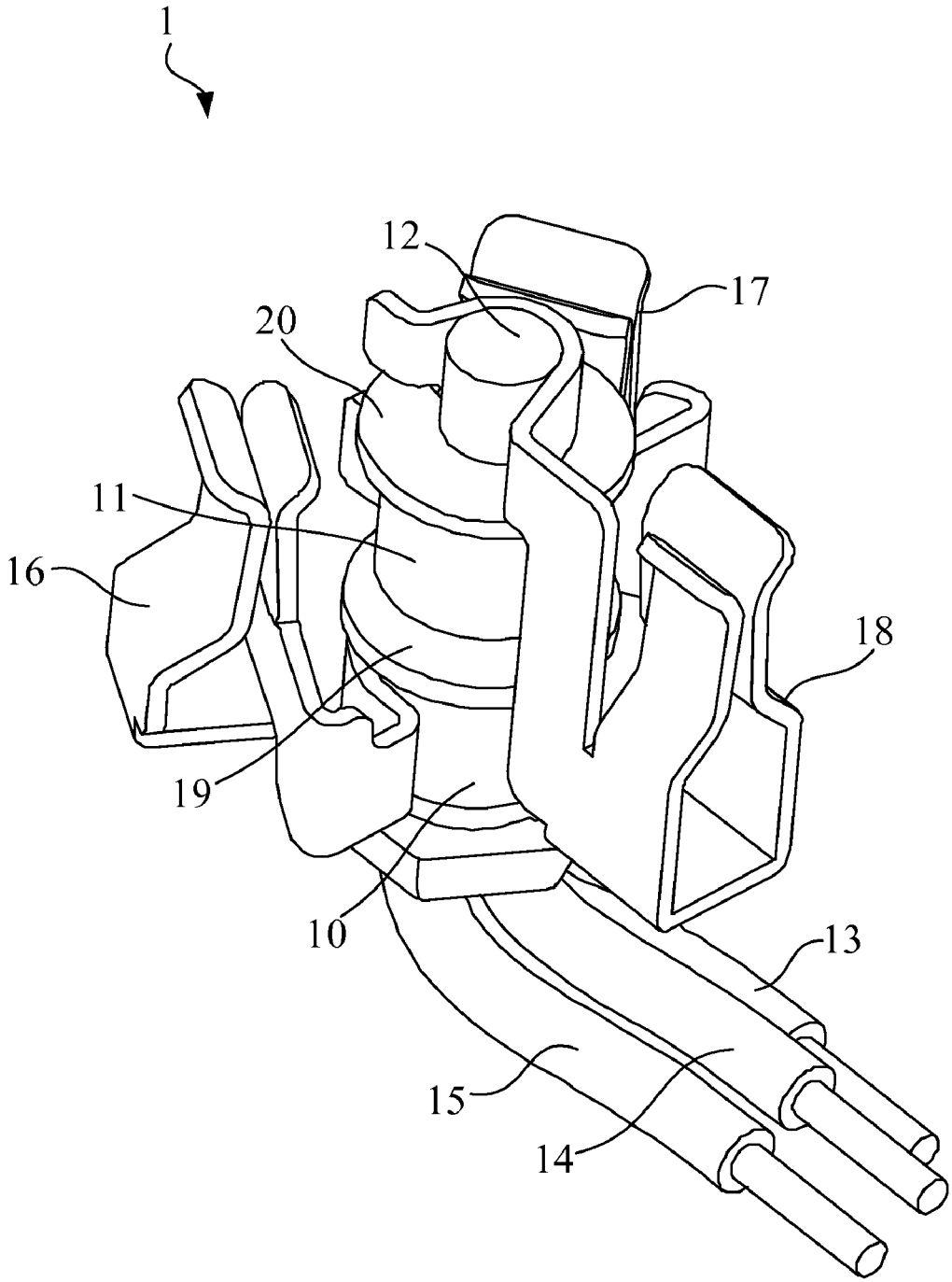
FIG. 1 is an exterior view of the freely rotatable electrical conduction structure of the present invention.
Figure 2:
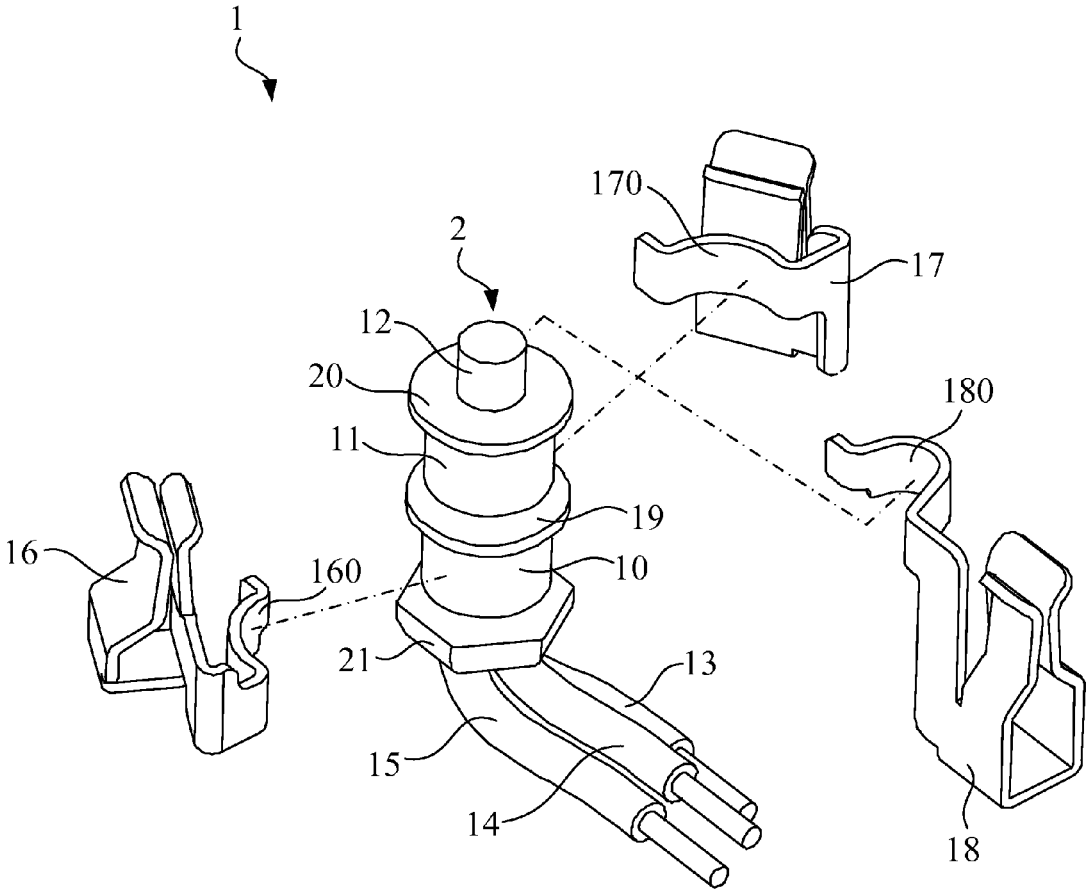
FIG. 2 is an explosive view of the electrical conduction structure in FIG. 1.
Figure 3:
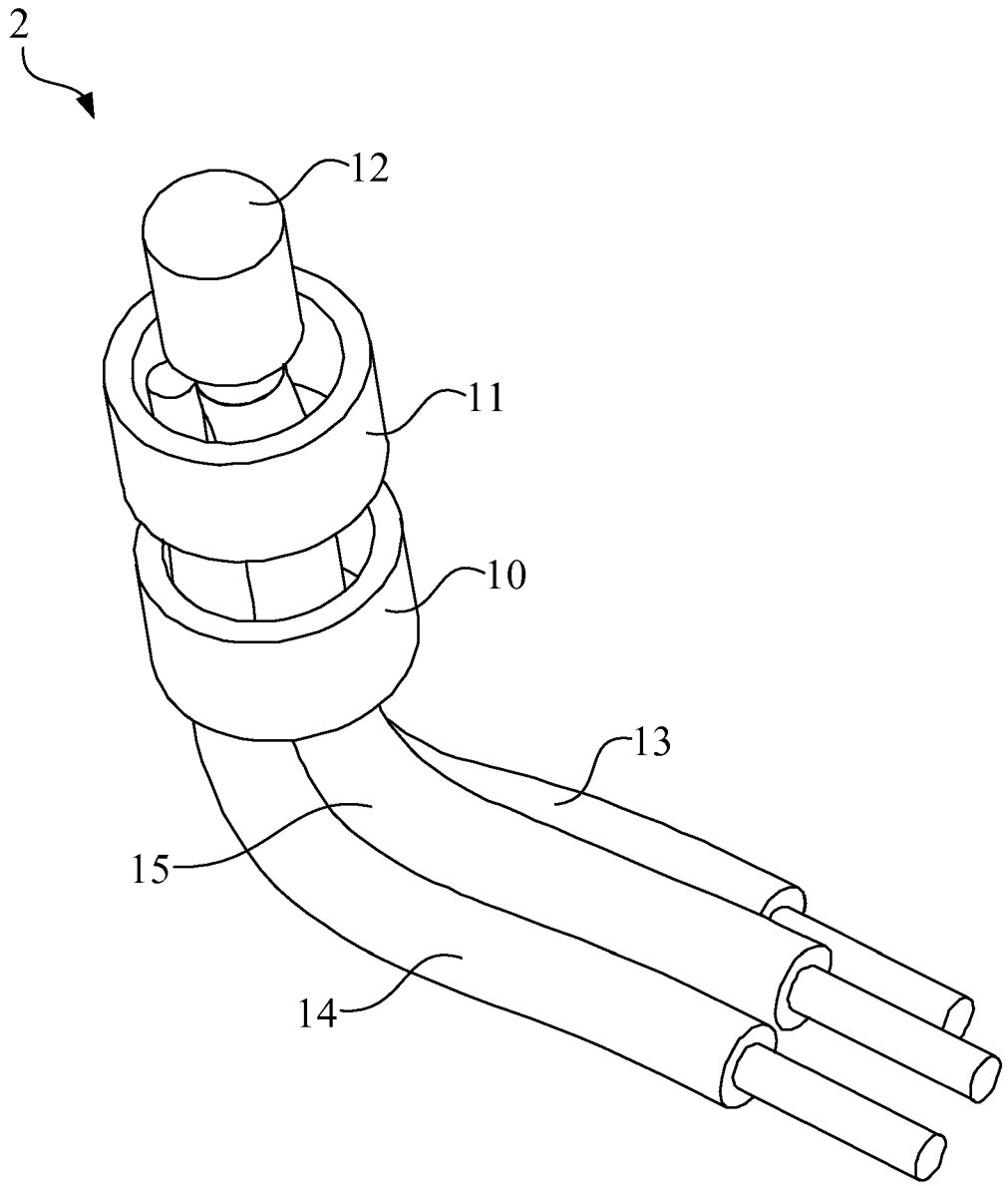
FIG. 3 illustrates the connections of the conducting wires and the inner surfaces of the cylindrical electrical conduction portions.

Please refer to FIG. 2. The electrical conduction structure 1 includes a first cylindrical electrical conduction portion 10, a second cylindrical electrical conduction portion 11, a third cylindrical electrical conduction portion 12, a live-wire electrical conduction terminal 16, a neutral-wire electrical conduction terminal 17, an earth-wire electrical conduction terminal 18, and an insulated material portion (including the portions 19, 20, and 21). The first cylindrical electrical conduction portion 10, the second cylindrical electrical conduction portion 11, and the third cylindrical electrical conduction portion 12 are arranged separately along an axis, wherein the inner surface of the first cylindrical electrical conduction portion 10 is welded with an end of a live wire 13, the inner surface of the second cylindrical electrical conduction portion 11 is welded with an end of a neutral wire 14, the inner surface of the third cylindrical electrical conduction portion 12 is welded with an end of an earth wire 15. It should be noted that the end of the earth wire and the inner surface of the third cylindrical electrical conduction portion may be connected by crimping instead.

The insulated material portion is combined with the first cylindrical electrical conduction portion 10, the second cylindrical electrical conduction portion 11, and the third cylindrical electrical conduction portion 12 via injection molding to form a circular shaft assembly 2. The live-wire electrical conduction terminal 16, the neutral-wire electrical conduction terminal 17, and the earth-wire electrical conduction terminal 18 are disposed inside the first receiving space 3320, the second receiving space 3321 and the third receiving space 3322 of the rotatable supporting seat 332, respectively, for clamping the insertion terminals of an external plug. The circular shaft assembly 2 is disposed inside the vertical channel 3325 of the rotatable supporting seat 332.

The insulated material portion can include a first circular insulated portion 19 and a second circular insulated portion 20. The first circular insulated portion 19 separates the first cylindrical electrical conduction portion 10 and the second cylindrical electrical conduction portion 11; the second circular insulated portion 20 separates the second cylindrical electrical conduction portion 11 and the third cylindrical electrical conduction portion 12. The diameter of each of the first circular insulated portion 19 and the second circular insulated portion 20 is bigger than that of each of the first cylindrical electrical conduction portion 10, the second cylindrical electrical conduction portion 11 and the third cylindrical electrical conduction portion 12.

Figure 8A:
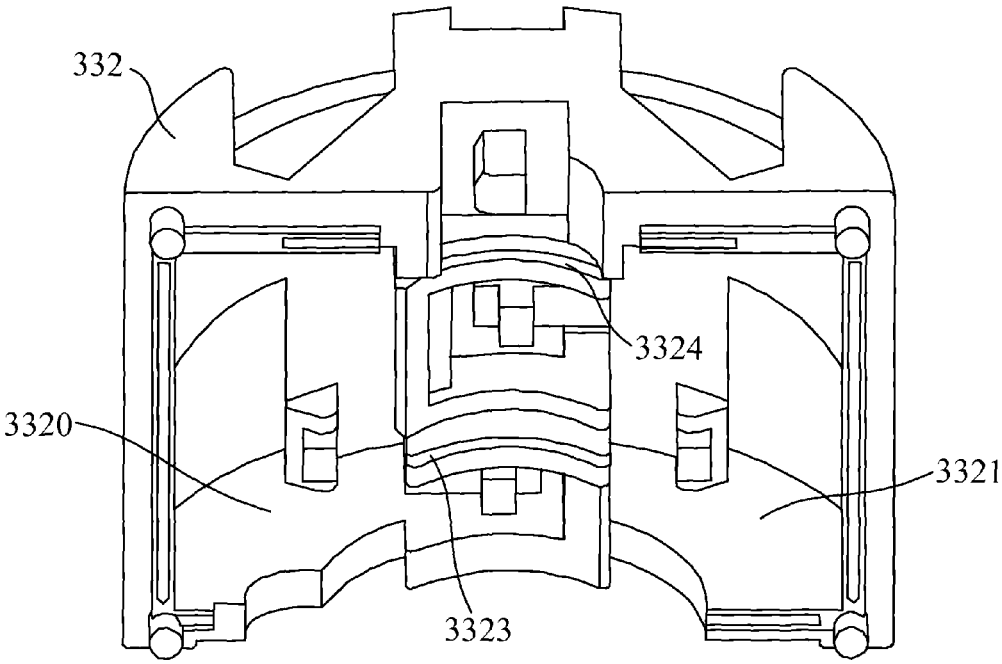
FIGS. 8A and 8B are the interior views of the left and right parts of the rotatable supporting seat.
Figure 8B:
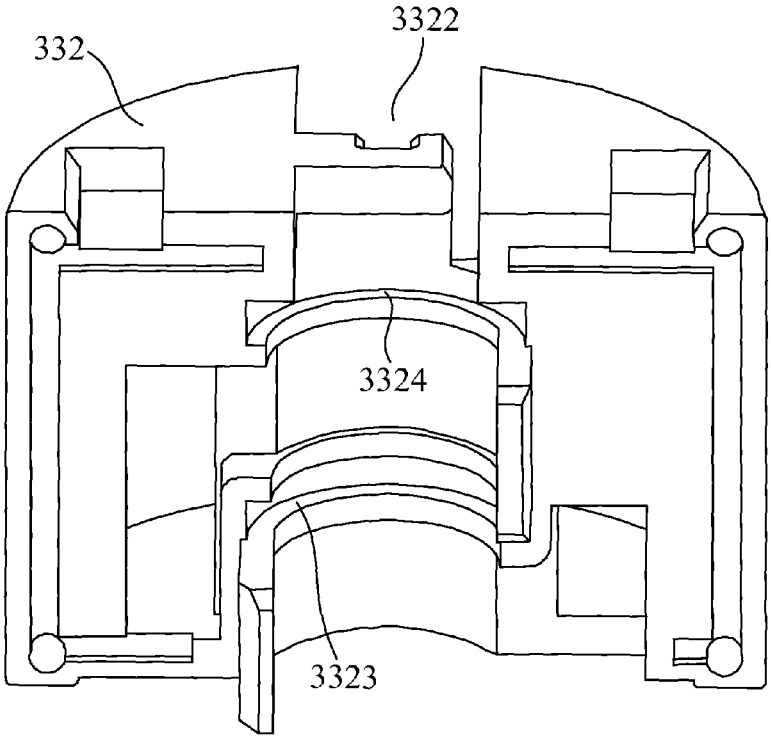

Please refer to FIG. 8A and FIG. 8B. Each of the left part and right part rotatable supporting seats 332 includes a first step structure 3323 and a second step structure 3324. The first circular insulated portion 19 is held onto the first step structure 3323, and the second circular insulated portion 20 is held onto the second step structure 3324. In this way, the circular shaft assembly 2 can be positioned in the vertical channel 3325 of the rotatable supporting seat 332. In addition, the insulated material portion can further include a hexangular anti-rotation portion 21 engaged to a hexangular recess structure (not illustrated) of the box 34 to prevent the rotation of the circular shaft assembly 2.

It should be particularly noted that the live-wire electrical conduction terminal 16, the neutral-wire electrical conduction terminal 17 and the earth-wire electrical conduction terminal 18 partially project to form a first arc contact portion 160 configured to abut onto the outer peripheral surface of the first cylindrical electrical conduction portion 10, a second arc contact portion 170 configured to abut onto the outer peripheral surface of the second cylindrical electrical conduction portion 11, and a third arc contact portion 180 configured to abut onto the outer peripheral surface of the third cylindrical electrical conduction portion 12, respectively.

Furthermore, the live-wire electrical conduction terminal 16, the neutral-wire electrical conduction terminal 17 and the earth-wire electrical conduction terminal 18 are allowed to rotate around the first cylindrical electrical conduction portion 10, the second cylindrical electrical conduction portion 11, and the third cylindrical electrical conduction portion 12, respectively, with the first arc contact portion 160, the second arc contact portion 170 and the third arc contact portion 180 keeping contacting and conducting with the outer peripheral surface of the first cylindrical electrical conduction portion 10, the outer peripheral surface of the second cylindrical electrical conduction portion 11, and the outer peripheral surface of the third cylindrical electrical conduction portion 12, respectively. The rotations of the live-wire electrical conduction terminal 16, the neutral-wire electrical conduction terminal 17 and the earth-wire electrical conduction terminal 18 can make the rotatable supporting seat 332 rotate around the circular shaft assembly 2 at the same time.

FIG. 4 is an exemplary embodiment of the freely rotatable electrical conduction structure disclosed in the present invention applying to a 3-pole receptacle. Practically, the design of the freely rotatable electrical conduction structure is applicable to other types (e.g. 2-pole) or electric standards of receptacles.

It is advantageous that after plugged into the receptacle of the present invention, an external plug of e.g. China electric standard is enabled to rotate freely and keep conducting with the receptacle by use of the electrical conduction structure as disclosed. As a result, the electrical conduction structure disclosed in the present invention can prevent one power plug of large volume or a particular shape from blocking the plugging of others.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A freely rotatable electrical conduction structure, comprising:

at least two cylindrical electrical conduction portions arranged separately along an axis, wherein an inner surface of each cylindrical electrical conduction portion is welded with an end of a conducting wire;

an insulated material portion combined with the at least two cylindrical electrical conduction portions via injection molding to form a circular shaft assembly; and at least two electrical conduction terminals corresponding to the at least two cylindrical electrical conduction portions respectively, and each electrical conduction terminal partially projecting to form an arc contact portion configured to abut onto an outer peripheral surface of the corresponding cylindrical electrical conduction portion of the electrical conduction terminal, the each electrical conduction terminal being allowed to rotate around the corresponding cylindrical electrical conduction portion of the electrical conduction terminal with the arc contact portion keeping contacting and conducting with the outer peripheral surface;

wherein the insulated material portion further comprises an anti-rotation portion engaged to a hexangular recess structure of a box to prevent the rotation of the circular shaft assembly.

2. The conduction structure of claim 1, wherein the insulated material portion comprises a circular insulated portion, located between the at least two cylindrical electrical conduction portions, a diameter of the circular insulated portion is bigger than that of each cylindrical electrical conduction portion, the circular insulated portion is for being held to position the circular shaft assembly.

3. A freely rotatable receptacle, comprising:

a circular plate where a set of 3-pole insertion holes are formed;

a first cylindrical electrical conduction portion, a second cylindrical electrical conduction portion, and a third cylindrical electrical conduction portion arranged separately along an axis, wherein an inner surface of the first cylindrical electrical conduction portion is welded with an end of a live wire, an inner surface of the second cylindrical electrical conduction portion is welded with an end of a neutral wire, an inner surface of the third cylindrical electrical conduction portion is welded with an end of an earth wire;

an insulated material portion combined with the first cylindrical electrical conduction portion, the second cylindrical electrical conduction portion, and the third cylindrical electrical conduction portion via injection molding to form a circular shaft assembly disposed under the circular plate; and a live-wire electrical conduction terminal, a neutral-wire electrical conduction terminal and an earth-wire electrical conduction terminal, partially projecting to form a first arc contact portion configured to abut onto an outer peripheral surface of the first cylindrical electrical conduction portion, a second arc contact portion configured to abut onto an outer peripheral surface of the second cylindrical electrical conduction portion, and a third arc contact portion configured to abut onto an outer peripheral surface of the third cylindrical electrical conduction portion, respectively;

wherein the live-wire electrical conduction terminal, the neutral-wire electrical conduction terminal and the earth-wire electrical conduction terminal are allowed to rotate around the first cylindrical electrical conduction portion, the second cylindrical electrical conduction portion, and the third cylindrical electrical conduction portion, respectively, with the first arc contact portion, the second arc contact portion and the third arc contact portion keeping contacting and conducting with the outer peripheral surface of the first cylindrical electrical conduction portion, the outer peripheral surface of the second cylindrical electrical conduction portion, and the outer peripheral surface of the third cylindrical electrical conduction portion, respectively.

4. The receptacle of claim 3, further comprising a rotatable supporting seat disposed under the circular plate, the rotatable supporting seat comprises a first receiving space, a second receiving space and a third receiving space formed from the outer top thereof and corresponding to the set of 3-pole insertion holes, the rotatable supporting seat comprises a central vertical channel inside where the circular shaft assembly is located.

5. The receptacle of claim 4, wherein the insulated material portion comprises a first circular insulated portion and a second circular insulated portion, the first circular insulated portion separates the first cylindrical electrical conduction portion and the second cylindrical electrical conduction portion, the second circular insulated portion separates the second cylindrical electrical conduction portion and the third cylindrical electrical conduction portion, the diameter of each of the first circular insulated portion and the second circular insulated portion is bigger than that of each of the first cylindrical electrical conduction portion, the second cylindrical electrical conduction portion and the third cylindrical electrical conduction portion, the first circular insulated portion and the second circular insulated portion are for being held inside the rotatable supporting seat to position the circular shaft assembly in the vertical channel.

6. The receptacle of claim 5, wherein the rotatable supporting seat comprises a first step structure and a second step structure, the first circular insulated portion is held onto the first step structure, and the second circular insulated portion is held onto the second step structure.

7. The receptacle of claim 3, further comprising a box for receiving the circular shaft assembly, the insulated material portion further comprises an anti-rotation portion engaged to a recess structure of the box to prevent the rotation of the circular shaft assembly.

* * * * *